US008876369B1

(12) United States Patent
Lott et al.

(10) Patent No.: US 8,876,369 B1
(45) Date of Patent: Nov. 4, 2014

(54) APPARATUS FOR MIXING LIQUIDS AND/OR SOLIDS WITH LIQUIDS

(71) Applicants: William Gerald Lott, Houston, TX (US); William Jeffery Lott, Houston, TX (US)

(72) Inventors: William Gerald Lott, Houston, TX (US); William Jeffery Lott, Houston, TX (US)

(73) Assignee: Compatible Components Corporation, Houston, TX (US)

( * ) Notice: Subject to any disclaimer, the term of this patent is extended or adjusted under 35 U.S.C. 154(b) by 0 days.

(21) Appl. No.: 14/222,845

(22) Filed: Mar. 24, 2014

(51) Int. Cl.
*B01F 7/20* (2006.01)
*B01F 7/00* (2006.01)

(52) U.S. Cl.
CPC ..... *B01F 7/0025* (2013.01)
USPC ..... 366/328.2; 416/91; 416/231 A

(58) Field of Classification Search
CPC ..... B01F 7/00158; B01F 7/00541
USPC ..... 366/163.2, 328.2; 416/91, 231 A
See application file for complete search history.

(56) References Cited

U.S. PATENT DOCUMENTS

| | | | | |
|---|---|---|---|---|
| 119,193 | A * | 9/1871 | Smith et al. | 366/328.2 |
| 122,075 | A * | 12/1871 | Still | 416/91 |
| 5,037,209 | A * | 8/1991 | Wyss | 366/246 |
| 5,152,606 | A | 10/1992 | Borraccia et al. | |
| 5,158,434 | A | 10/1992 | Wettman | |
| 5,316,443 | A | 5/1994 | Smith | |
| 5,813,837 | A | 9/1998 | Yamamoto et al. | |
| 6,334,705 | B1 | 1/2002 | Weetman | |
| 7,665,886 | B2 * | 2/2010 | Morris et al. | 366/262 |
| 2007/0217286 | A1 * | 9/2007 | Morris et al. | 366/328.2 |
| 2007/0217287 | A1 * | 9/2007 | Morris et al. | 366/328.2 |
| 2011/0249529 | A1 * | 10/2011 | Hirzel | 366/343 |

* cited by examiner

*Primary Examiner* — David Sorkin

(57) ABSTRACT

A mixing apparatus has a shaft, at least one arm radiating outwardly of the shaft, and a mixing element affixed to the arm away from the shaft. The mixing element has a generally frustoconical member with a wide opening at an end thereof and a narrow opening at an opposite end thereof. The mixing element also includes a throat section of a generally constant diameter connected to the narrow opening of the frustoconical member and a diffuser section having an end affixed to an end of the throat section opposite the frustoconical member. The mixing elements have a longitudinal axis extending at an acute angle to horizontal. A motor is cooperative with the shaft so as to rotate the shaft. Each of the mixing elements includes a Venturi.

12 Claims, 4 Drawing Sheets

APPARATUS FOR MIXING LIQUIDS AND/OR SOLIDS WITH LIQUIDS

CROSS-REFERENCE TO RELATED APPLICATIONS

Not applicable.

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

INCORPORATION-BY-REFERENCE OF MATERIALS SUBMITTED ON A COMPACT DISC

Not applicable.

BACKGROUND OF THE INVENTION

1. Field of the Invention

The present invention relates to mixing apparatus for mixing dissimilar liquids or mixing particulate matter with liquids. More particularly, the present invention relates to vertical mixers having a vertical shaft extending in a tank. Additionally, the present invention relates to mixing systems in which Venturis are utilized.

2. Description of Related Art Including Information Disclosed Under 37 CFR 1.97 and 37 CFR 1.98.

Batch liquid mixing has three important industrial applications. These applications include blending of multiple miscible liquids, suspending solids in a carrier liquid, and for promoting heat transfer. The volume of batch liquid is mixed by an internally-mounted mixing device, generally known as an agitator impeller. The impeller is a single propeller or turbine blade connected to a rotating shaft that is driven by an electric motor at a fixed rotational speed. In some applications, a variable-speed gearbox is installed to control the shaft rotational speeds.

There are two classes of impeller agitators, namely, axial-flow and radial-flow. Axial-flow impellers impart a current parallel with the axis of the impeller shaft. Radial-flow impellers generate currents in a tangential or radial direction to the axis of the impeller shaft. In these two classes of impellers, there exists three primary designs, namely, propeller, turbine and paddle. Each of these primary designs has a geometrical design variation. These three primary types of impellers are utilized in approximately 95% of batch liquid agitation systems.

Standard propellers have two, three or four blades, depending on the mixing application intensity. A revolving impeller traces out a helix in the liquid. A full revolution moves the liquid a fixed distance. The ratio of distance to the propeller diameter is known as the "pitch". Propellers are member of the axial-flow class of impeller agitators. Turbines have six to eight blades mounted at the end of the agitator shaft. These are a member of the radial-class of impeller agitators. The turbine diameter is approximately 30 to 50% of the vessel diameter. Paddles are generally two or four blades mounted on the end of the agitator shaft. They are a subset of the radial class of impeller agitators. Typically, the paddle diameter is 50 to 80% of the tank diameter.

Blade and turbine propellers that are utilized in batch agitating and mixing have a generated induced flow that is unstable. As such, the circumferential flow velocity will fluctuate as the liquid leaves the tips of the blades. The agitator impeller is essentially a pumping device operating without the confines of a casing or direct inlet and outlet flow. As the impeller rotates, fluid is forced outwardly from the blade tip. The movement force is a vector that can be described by radial and tangential velocity components.

Unfortunately, in these prior art designs, there can be an improper mixing of the liquids or an ineffective mixing of the liquids. In those circumstances where particulate matter is to be mixed with a liquid, these types of prior mixing apparatus will have a tendency to cause the solids to drift toward the corners or edges of the tanks. As such, a clean-out, or other operation, may be necessary to reinstill these remaining solid particles within the liquid. These prior systems are generally ineffective in assuring that virtually all of the solid particulate material will be entrained or mixed with the liquid. These prior mixing apparatus are also less-than-effective in drawing the particulate matter from the bottom of the tank upwardly so as to be mixed with the liquid. Most of the solid particulate matter will have to be mixed as the solid particulate matter is drifting downwardly in the liquid from a supply introduced above the liquid.

In the past, various patterns of issued relating to mixing apparatus. For example, U.S. Pat. No. 5,152,606, issued on Oct. 6, 1992 to Borraccia et al., describes a mixer impeller shaft attachment apparatus which is adapted to mix and blend liquids and liquid suspensions in industrial and commercial applications. The mixer impeller is secured to the shaft by collars which are threaded on the ends of hubs from which the blades of the impeller extend. In order to secure the attachment of the collars to the hub, a locking key is inserted between the collar and the shaft. The inner periphery of the collars are tapered outwardly away from the shaft. The impeller is restrained against axial movement by the collar and against rotational movement by being keyed to the shaft and restricted by the ramp on the collar.

U.S. Pat. No. 5,158,434, issued Oct. 27, 1992 to R. J. Wettman, teaches a mixing impeller and impeller system for mixing and blending liquids and liquid suspensions. The impellers have a plurality of separate blades and have camber and twist. The angle at the tip of two diametrically disposed blades of a four blade impeller may have different blade angles at the tip than the other pair of blades. The impellers may be of different diameters and disposed in close proximity so that they are in independent relationship. The impellers and impeller systems provide axial flow over a large range of viscosities of the liquid or liquid suspension.

U.S. Pat. No. 5,316,443, issued on May 31, 1994 to J. M. Smith, teaches a reversible mixing impeller that is designed for the chemical processing industry to provide a generally axial flow when rotated in a first direction of rotation to provide a generally radial flow when rotated in the opposite direction of rotation. The blades are formed of sheet material with an edge which leads in the first direction of rotation being defined by a portion of the blade which is folded and turned in a chordwise sense to a limited extent back upon itself. The folded back leading edge forms a rearwardly facing concavity which bases the blade trailing edge.

U.S. Pat. No. 5,813,837, issued on Sep. 29, 1998 to Yamamoto et al., describes an axial-flow impeller for mixing liquids. This axial-flow impeller has a maximum blade with less than 20% of the impeller diameter. The pitch angle at the radial position is 12° to 22°. The width at the tip and portion of the blade is 12 to 75% of the width at the radial position.

U.S. Pat. No. 6,334,705, issued on Jan. 1, 2002 to R. J. Weetman, discloses a fluid mixing impeller with a shear generating Venturi. This impeller is used in a sparging system for dispersion and for mass transfer of a liquid phase or a gaseous phase into a liquid which is being mixed or agitated. The impeller forms a shear field which breaks the phase being dispersed in defined bubbles which are dispersed by the impeller. A structure is provided which forms a Venturi that is located on the side or sides of the blade where the phase occurs, in particular, in the high-velocity region near the tip of the blade. The structure is provided by a pair of proplets in the vicinity of the tip end of the blade which form a wedge-shaped flow path there between.

It is an object of the present invention to provide a mixing apparatus that enhances the mixing of dissimilar fluids and/or the mixing of fluids with solids.

It is another object of the present invention to provide a mixing apparatus that reduces the static head in the front of the mixing element.

It is another object of the present invention to provide a mixing apparatus that reduces the horsepower requirements for the mixer.

It is still another object of the present invention to provide a mixing apparatus that lifts solids from the bottom and/or corners of the tank.

It is a further object of the present invention provide a mixing apparatus that provides increased turbulence during the mixing process.

It is another object of the present invention provide a mixing apparatus that dynamically shears particles.

It is a further object of the present invention provide a mixing apparatus that generates overlapping vortices.

It is another object of the present invention to provide a mixing apparatus that can be utilized with various tank configurations.

It is another object of the present invention to provide a mixing apparatus that allows for the control of boundary layers of fluids.

It is still a further object of the present invention to provide a mixing apparatus that enhances the physical properties of the liquid constituents.

It is still further object of the present invention to provide a mixing apparatus that effectively mixes liquids and slurries without degrading the product.

These and other objects and advantages of the present invention will become apparent from a reading of the attached specification and appended claims.

BRIEF SUMMARY OF THE INVENTION

The present invention is a mixing apparatus that comprises a shaft, at least one arm radiating outwardly of the shaft, and a mixing element affixed to the arm away from the shaft. The mixing element has a generally frustoconical member that has a wide open at one end thereof and a narrow opening at an opposite end thereof.

A motor is cooperative at the shaft so as to rotate the shaft in a direction. The wide opening of the generally frustoconical member opens to the direction of rotation of the shaft. A hub is affixed to the shaft. The arm has one end opposite the frustoconical member that is affixed to the hub.

In the present invention, the arm comprises at least a pair of arms. The mixing element comprises at least two mixing elements respectively affixed to the pair of arms. Each of the mixing elements also includes a throat section connected to the narrow end of the frustoconical member, and a diffuser section having an end connected to an end of the throat section opposite the frustoconical member. The diffuser section has an opposite end with a diameter greater than a diameter of the throat section. The opposite end of the diffuser has a plurality of cutouts formed therein in spaced relation to each other. Each of the plurality of cutouts has a scalloped shape. The plurality of scallops includes between four cutouts and eight cutouts. Each of the cutouts/scallops have an open end opening at the edge of the diffuser section. The throat has a generally constant diameter. The wide end of the frustoconical member has a diameter greater than a diameter of the opposite end of the frustoconical section.

The present invention, the shaft extends in a vertical orientation. The arms extend in a horizontal orientation. The mixing element can be angularly adjustably mounted onto the end of the arm. The mixing element has a longitudinal axis that has an angle of between 0° and 35° to horizontal. In the preferred embodiment of the present invention, the longitudinal axis of the mixing element extends at 25° to horizontal.

The present invention can further include a tank having an interior volume. The shaft extends vertically within the interior volume of the tank. The mixing elements are positioned within the interior volume of the tank. The arm includes three arms extending in evenly spaced relationship to each other. The mixing element includes three mixing elements respectively mounted at the end of the three arms opposite the shaft. Each of the mixing elements includes a Venturi section and diffuser.

The present invention is a vertical mixing apparatus that mixes, dispenses and suspends particulates (if present) in a first liquid, with a second liquid, or with multiple liquids with varying physical characteristics, densities and viscosities. Each mixing element includes a diverging/converging inlet, a Venturi throat section and a terminating diffuser section. The diffuser section has scallops around the circumference of the circular outlet. The scallops serve to generate turbulent vortices that enhance the mixing process.

In operation, the rotating shaft, as driven by power source, such as a motor, will cause the surrounding liquid at or the converging/diverging inlet of each mixing element. As the liquid passes from the diverging to converging section, the velocity of the liquid will increase as it passes through the throat. This action will generate a low-pressure environment surrounding the rotating mixing element causing more liquid to enter the mixing elements. The additional liquid entering the mixing elements will enhance the velocity of the slurry which, in turn, will increase the low-pressure region. As the liquid passes from the Venturi throat section to the diverging/diffuser section, the liquid velocity is reduced, converting from low-pressure to high-pressure. As the trailing flow exits the diffuser section, overlapping vortices develop, generated by the liquid passing through the scallops of the diffuser. The Venturi effect is a jet effect, such as with a funnel. The fluid velocity increases as the cross-sectional area decreases, but the static pressure correspondingly decreasing.

The mixing elements are designed for enhanced boundary layer control. The angle of the diffuser will maintain a boundary layer so as to prevent fluid stall and separation. This will generate a radial flow path in a tank and draws the surrounding liquid into a circular pattern. The circular motion will hold the fluid in turbulent motion without causing solids to settle into the corners of the tank. This results in less horsepower requirements and less torque requirements for the shaft.

The foregoing Section is intended to describe, with particularity, the preferred embodiment of the present invention.

It is understood that modifications to this preferred embodiment can be made within the scope of the present invention. As such, this Section should not to be construed, in any way, as limiting of the broad scope of the present invention. The present invention should only be limited by the following claims and their legal equivalents.

DETAILED DESCRIPTION OF THE INVENTION

Figure 1:
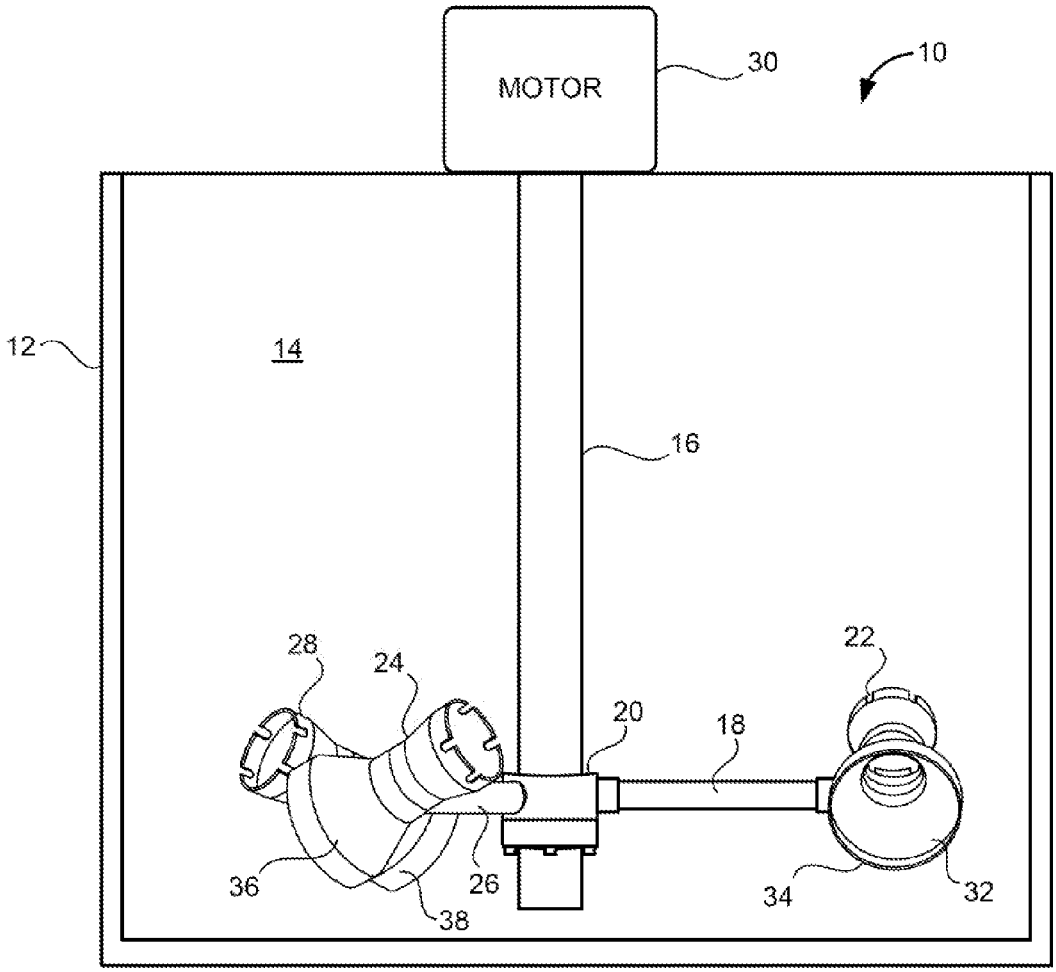
FIG. 1 is a side elevation of showing the mixing apparatus in accordance with the present invention.

Referring to FIG. 1, there shown the mixing apparatus 10 in accordance with the preferred embodiment of the present invention. The mixing apparatus 10 includes a tank 12 having an interior volume 14. A shaft 16 extends vertically within the interior volume 14 of tank 12. An arm 18 is affixed to the shaft 16 by way of hub 20. The mixing element 22 is attached to the end of the arm 18 opposite the hub 20 and away from the shaft 16.

Also, in FIG. 1, it can be seen that there is another mixing element 24 that is affixed to an arm 26. The arm 26 is also connected to hub 20. A third mixing element 28 will be connected by another arm (not shown), also connected to the hub 20. The arms associated with the mixing elements 22, 24 and 28 will be evenly spaced from each other. Each of the arms 18 and 26 extend in a generally horizontal plane. A motor 30 is cooperative with the shaft 16 so as to cause the shaft 16 to rotate within the interior volume 14 of the tank 12.

Within the concept of the present invention, the tank 12 can have a wide variety of configurations. In particular, the tank can be of a cylindrical shape, a square shape, a rectangular shape, or any other configuration. Importantly, the mixing apparatus 10 of the present invention is adaptable to any particular shape of tank that is utilized.

The mixing element 22 has a generally frustoconical section 32 formed at an end thereof. The frustoconical section 32 will have a wide opening 34 at an end thereof. Similarly, the mixing element 24 will also have a frustoconical section 36. The mixing element 28 will also have a frustoconical section 38. The wide openings of each of the frustoconical sections 32, 36 and 38 will generally face the direction of rotation of the shaft 16. As such, liquid and/or solids within the interior volume of tank 12 will be forced into the frustoconical sections 32, 36 and 38 by the rotation of the shaft 16.

Figure 3:
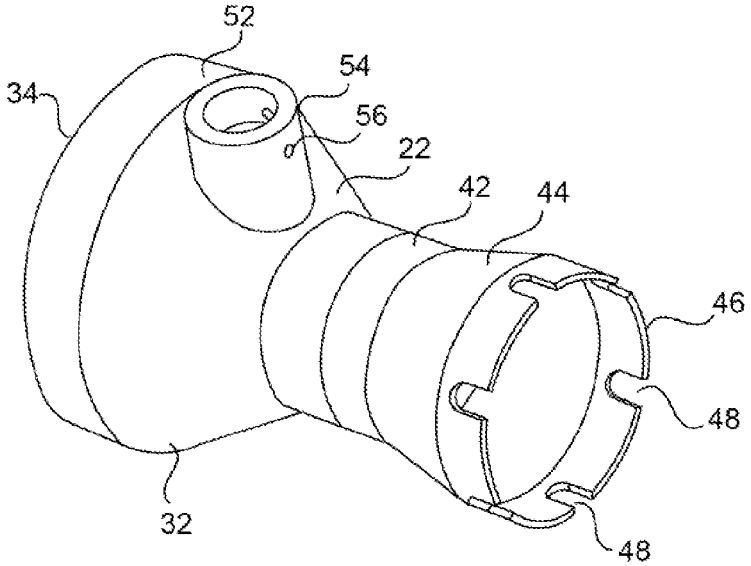
FIG. 3 is a perspective view showing the mixing element is used in the mixing apparatus of the present invention.

FIG. 3 is an further illustration of the components of mixing apparatus 10 of the present invention. As can be seen, the hub 20 is affixed to the shaft 16 adjacent a lower end thereof. The hub 20 is rigidly affixed to the shaft 16 so as to rotate with the rotation of the shaft 16. The first arm 18 is connected to the hub 20 and also connected to the mixing element 22. The arm 26 is further connected to the hub 20 and also to the mixing element 24. Arm 40 is affixed to the hub 20 and also affixed to the mixing element 28. It can be seen that each of the arms 18, 26 and 40 are evenly angularly spaced from each other and extend in the same horizontal plane.

Figure 2:
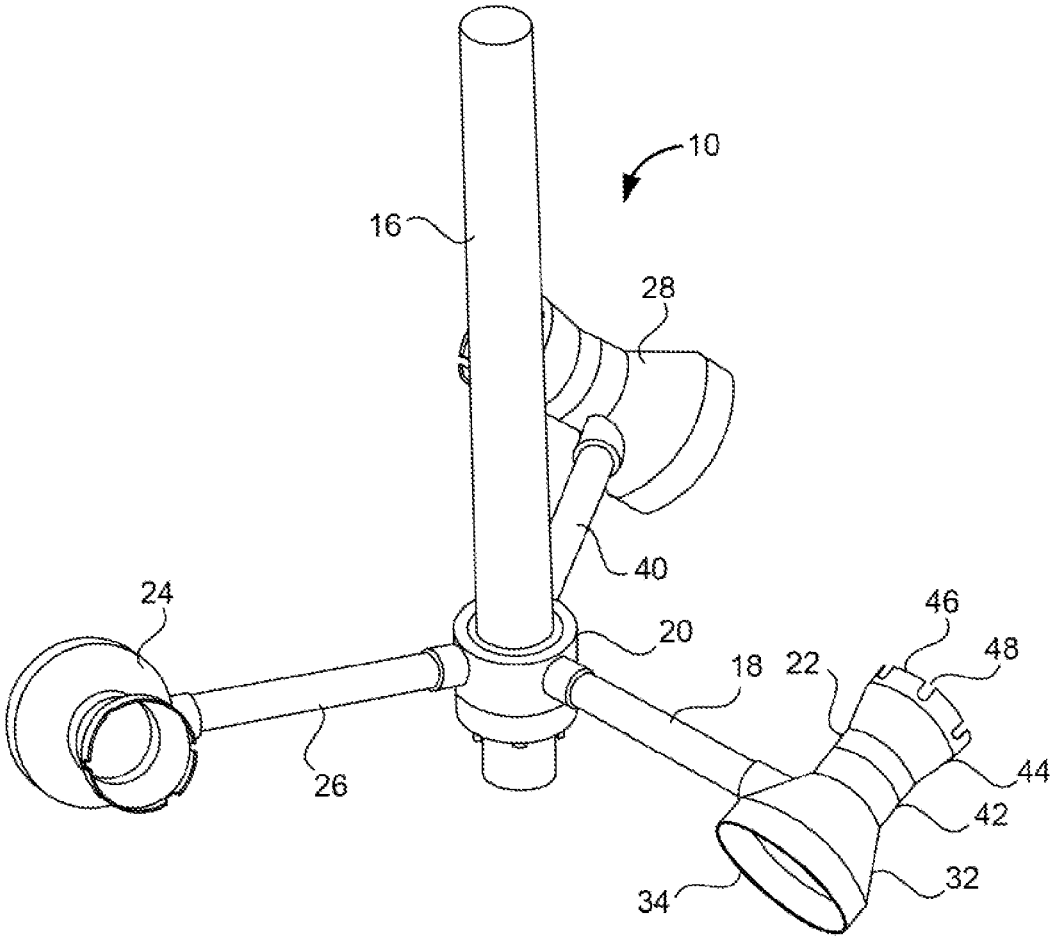
FIG. 2 is a perspective view showing the mixing apparatus of the present invention.

In FIG. 2, and as will be described hereinafter, each of the mixing elements 22, 24 and 28 includes a generally frustoconical section, a throat section and a diffuser section. The mixing element 22 includes the frustoconical section 32 is connected to the throat section 42 at a narrow diameter opening thereof opposite the wide diameter opening 34. The diffuser section 44 is connected to the opposite end of the throat section 42 and generally widens therefrom so as to have end opening 46. The plurality of cutouts 48 are formed on this end opening 46. The mixing elements 24 and 28 will have a similar configuration to that of mixing element 22.

FIG. 3 is a perspective view showing the mixing element 22. As can be seen, mixing element 22 has the frustoconical section 32 with a wide diameter opening 34 at one end thereof. A generally constant diameter portion 52 is formed adjacent to the wide diameter opening 34. The narrowing diameter of the frustoconical section 32 will extend to the throat section 42. The throat section 42 is of a constant diameter. A connector 54 is affixed to the frustoconical section 32. Connector 54 is suitable for receipt of an end of the arm 18 therein. The mixing element 22 can be angularly adjustable with respect to the arm 18 through the use of a set screw 56 formed on the receptacle 54.

The diffuser section 44 has a narrow diameter end connected to the throat section 42. The diffuser section 44 will widen so as to have an open end edge 46 formed at the end of the diffuser section 44 opposite the throat 42. The plurality of cutouts 48 are formed on this end edge 46 so as to extend thereinto. Each of the cutouts 48 has a scalloped shape. The scalloped shape will have an open end opening at the end edge 46 of the diffuser section 44.

Figure 4:
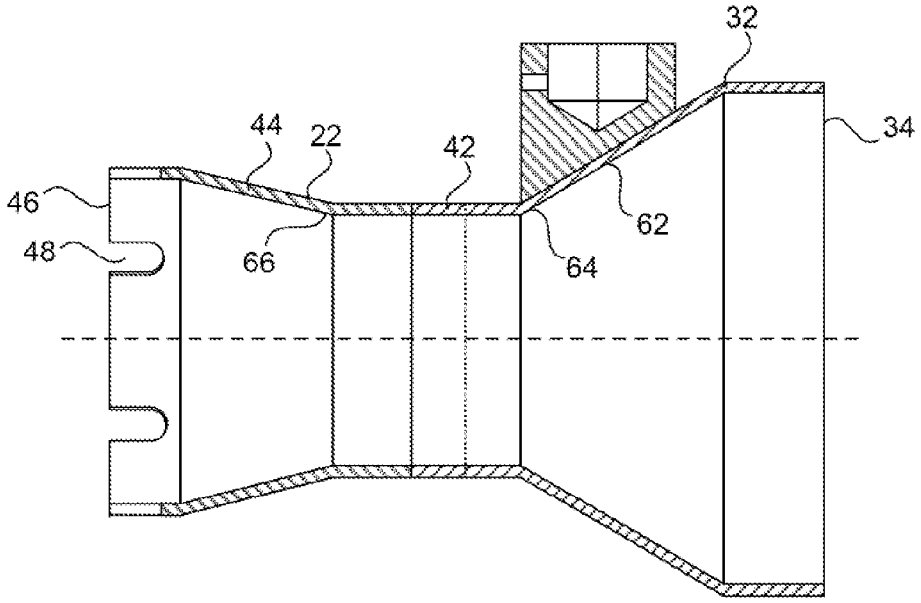
FIG. 4 is a cross-sectional view showing the mixing element of the mixing apparatus of the present invention.

In FIG. 4, there shown a cross-sectional view of the mixing element 22. In particular, the generally frustoconical section 32 has its wide opening 34 at one end thereof. The inner surface 62 of the generally frustoconical section 32 will narrow in diameter toward a narrow diameter end 64. The throat section 42 is connected to the narrow diameter end 64 of the generally frustoconical section 32. The diffuser section 44 has a narrow diameter end 66 that is connected to the end of the throat section 42 opposite the generally frustoconical section 32. The end edge 46 of the diffuser section 44 has the cutouts 48 formed therein.

With reference to FIG. 2, it can be seen that each of the mixing elements 22, 24 and 28 has a longitudinal axis that is canted at an acute angle to horizontal. In one form of the present invention, this acute angle can be adjustable from between 0° to 35°. Alternatively, each of the mixing elements 22, 24 and 28 can have a fixed non-adjustable position. Ideally, each of the mixing elements 22, 24 and 28 has a longitudinal axis extending at approximately 25° to vertical.

In normal use, as the shaft 16 rotates, the liquid (and associated solid particulate matter) is forced through the generally frustoconical section of each of the mixing elements 22, 24 and 28. The liquid (and associated particles) will then pass through the throat sections of each of the mixing elements 22, 24 and 26. The diffuser sections of each of the mixing elements will then cause the liquid (and entrained particles) to flow outwardly therefrom. As the liquid passes from the frustoconical section, the velocity of the liquid will increase as it passes through the throat. This action generates a low-pressure environment surrounding the rotating mixing elements 22, 24 and 28 so as to cause more liquid to enter the mixing elements. The additional liquid entering the mixing elements will enhance the velocity of the slurry which, in turn, will decrease the low-pressure region. As the liquid passes from the throat section to the diffuser section, the liquid velocity is reduced, converting from low-pressure to high-pressure. As the trailing flow exits the diffuser sections, overlapping vortices develop, generated by the liquid passing through cutouts of the diffuser. This Venturi effect is similar to a jet effect in which the fluid velocity increases as the cross-sectional area decreases, with the static pressure correspondingly decreasing.

According to the laws governing fluid dynamics, a fluid velocity must increase as it passes through a constriction to satisfy the principle of continuity. The pressure must decrease to satisfy the principle of conservation of mechanical energy.

The use of the canted mixing elements 22, 24 and 28 has being found to increase turbulence within the mixing liquid. Additionally, this configuration will have a "drawing" effect. As a result, any particles that may be residing on the bottom of the tank 12, or in the corners of rectangular tank, are drawn into the mixing elements by way of this action. As such, the present invention avoids the accumulation of particulate material within the tank corners and bottom. The present invention minimizes any clean-out that may be required after the mixing operation occurs.

Experiments have been conducted with the present invention with respect to the configuration of the cutouts (or scallop-shaped areas) on the diffuser sections. Experiments have determined that between four cutouts and eight cutouts can be utilized so as to enhance the effect of the rotating overlapping vortices. The scalloped shape of such cutouts further enhances the development of such vortices. Each of the cutouts is evenly spaced from each other around the diameter of the end of the diffuser section.

The rotation of the vertical shaft will generate a low-pressure region at the feed inlet of each of the mixing elements. As the rotational speed increases, a pressure decrease in the surrounding region of the mixing elements occurs. This low-pressure region is generated by the increase in velocity of the mixture entering the throat of the mixing element. The low-pressure regions will cause the fluid mixture to flow more easily through the mixing element as the drive shaft speed increases. Unlike blade-type impellers that centrifugally throw the fluid mixture outward to accumulate in the corners of the tank, the mixing elements of the present invention draw the surrounding fluid mixture toward the low-pressure regions so as to engulf more of the mixture. As a result, less horsepower would be required because there is less resistance to flow.

Figure 5:
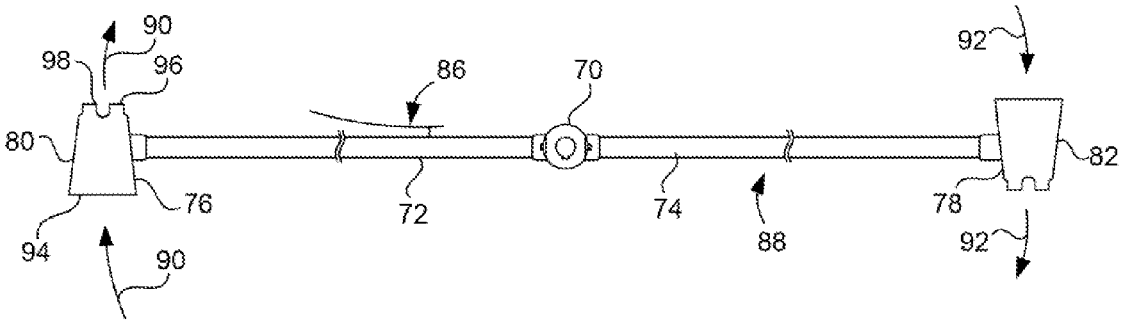
FIG. 5 is a plan view showing a simplified form of the mixing apparatus of the present invention.

FIG. 5 illustrates the simplest form of the present invention. In FIG. 5, can be seen that there is a shaft 70 having a first arm 72 and a second arm 74 extending radially outwardly therefrom. The first arm 72 is 180° away from the second arm 74. A first mixing element 76 is secured to the end of the arm 72 opposite the shaft 70. A second mixing element 78 is affixed to the end of the arm 74 opposite the shaft 70.

In FIG. 5, it can be seen that each of the mixing elements 76 and 78 is formed of a generally first frustoconical section. In particular, the mixing element 76 is formed by frustoconical section 80. The second mixing element 78 has a frustoconical section 82.

Arrows 86 and 88 illustrate the direction of rotation of the shafts 70 and the arms 72 and 74. Arrows 90 and 92 illustrate the fluid flow pattern through each of the mixing elements 76 and 78.

In the simple embodiment of FIG. 5, there is no throat section nor diffusion section associated with each of the mixing elements 76 and 78. As such, the liquid flow will pass through the wide end 94 of the frustoconical section 80 of mixing elements 76 and then passed through the narrow end 96 of the frustoconical section 80. Scallop-shaped cutouts 98 can be provided on the narrow opening 96 so as to enhance the formation of overlapping vortices. The mixing elements 78 will have a similar configuration but will be rotated in an opposite direction.

It should be noted that the present invention can have a variety of configurations. In particular, between two and four mixing elements are believed to be optimal for the mixing apparatus of the present invention. The mixing elements, and associated arms, can be provided in a single horizontal plane. Alternatively, several mixing elements can be located in a staggered relationship along the length of the shaft. Within the concept of the present invention, it can be contemplated that there are a pair of mixing elements located at generally the same horizontal level adjacent to the bottom of the shaft and another pair of mixing elements located above the first pair of mixing elements. The mixing elements can be offset from each other in a desired orientation.

The foregoing disclosure and description of the invention is illustrative and explanatory thereof. Various changes in the details of the illustrated construction can be made within the scope of the appended claims without departing from the true spirit of the invention. The present invention should only be limited by the following claims and their legal equivalents.

We claim:

1. A mixing apparatus comprising:
- a shaft;
- at least one arm radiating outwardly of said shaft;
- a mixing element affixed to said arm away from said shaft, said mixing element having a generally frustoconical interior having a wide opening at one end thereof and a narrow opening at an opposite end thereof, said mixing element further comprising:
  - a throat section connected to said narrow end of said frustoconical interior, said throat section having an inner wall; and
  - a diffuser section having an end connected to an end of said throat section opposite said frustoconical interior, said diffuser section having an opposite end having an interior diameter greater than an interior diameter of said throat section, said diffuser section having an inner wall continuous of said inner wall of said throat section, said opposite end of said diffuser section having a plurality of cutouts formed therein in spaced relation to each other.

2. The mixing apparatus of claim 1, each of said plurality of cutouts having a scallop shape.

3. The mixing apparatus of claim 1, said plurality of cutouts comprising between four cutouts and eight cutouts, each of said cutouts having an open end opening at an edge of the diffuser section.

4. The mixing apparatus of claim 1, said throat section having a constant diameter.

5. The mixing apparatus of claim 1, said wide opening of said interior having a diameter greater than a diameter of said opposite end of said diffuser section.

6. The mixing apparatus of claim 1, said shaft extending in a vertical orientation, said at least one arm extending in a horizontal orientation.

7. The mixing apparatus of claim 1, said mixing element being angularly adjustably mounted at an end of the arm.

8. The mixing apparatus of claim 1, said mixing element having a longitudinal axis, said longitudinal axis extending at an angle of between 0° and 35° to horizontal.

9. The mixing apparatus of claim 8, said longitudinal axis of said mixing element extending at 25° to horizontal.

10. The mixing apparatus of claim 1, further comprising:
- a tank having an interior volume, said shaft extending vertically within said interior volume.

11. The mixing apparatus of claim 1, said at least one arm comprising three arms extending in evenly spaced relationship to each other, said mixing element comprising three mixing elements respectively mounted to an end of said three arms opposite said shaft.

12. The mixing apparatus of claim 1, said mixing element comprising a Venturi.

* * * * *